US012583649B2

(12) United States Patent
Lohrman

(10) Patent No.: US 12,583,649 B2
(45) Date of Patent: Mar. 24, 2026

(54) MODIFIED SIDEWALL OF TETHERED CLOSURE

(71) Applicant: Silgan White Cap LLC, Downers Grove, IL (US)

(72) Inventor: Richard D. Lohrman, Montgomery, IL (US)

(73) Assignee: Silgan White Cap LLC, Downers Grove, IL (US)

( * ) Notice: Subject to any disclaimer, the term of this patent is extended or adjusted under 35 U.S.C. 154(b) by 280 days.

(21) Appl. No.: 17/328,170

(22) Filed: May 24, 2021

(65) Prior Publication Data

US 2022/0371785 A1 Nov. 24, 2022

(51) Int. Cl.
*B65D 41/34* (2006.01)
*B65D 55/16* (2006.01)

(52) U.S. Cl.
CPC ..... *B65D 41/3428* (2013.01); *B65D 55/16* (2013.01)

(58) Field of Classification Search
CPC ..... B65D 41/3428; B65D 55/16
USPC ..... 220/253
See application file for complete search history.

(56) References Cited

U.S. PATENT DOCUMENTS 3,904,062 A 9/1975 Grussen
3,944,102 A 3/1976 Grau
4,526,282 A 7/1985 Dutt et al.
4,564,114 A * 1/1986 Cole ..... B65D 55/16 215/256
4,567,993 A 2/1986 Albrecht et al.
4,984,701 A * 1/1991 Margaria ..... B65D 41/3447 215/256
5,050,753 A 9/1991 Trump et al.
5,107,998 A 4/1992 Zumbuhl
5,167,335 A 12/1992 McBride et al.
5,205,426 A 4/1993 McBride et al.
5,215,204 A * 6/1993 Beck ..... B65D 55/16 215/258
5,402,901 A 4/1995 Carvalheiro et al.
D381,906 S 8/1997 Bartsch
5,725,115 A 3/1998 Bosl et al.
5,779,076 A 7/1998 Kano
6,213,321 B1 4/2001 Zumbuhl
(Continued)

FOREIGN PATENT DOCUMENTS

GB 1593072 A * 7/1981 ..... B65D 41/3428
KR 10-0872159 1/2009
(Continued)

OTHER PUBLICATIONS

International Search Report and Written Opinion for International Application No. PCT/US2022/025936, dated Aug. 10, 2022, 13 pages.

*Primary Examiner* — Don M Anderson
*Assistant Examiner* — Eric C Baldrighi
(74) *Attorney, Agent, or Firm* — Reinhart Boerner Van Deuren s.c.

(57) ABSTRACT

A closure includes a cap having a top wall and a skirt perpendicular to the top wall and extending downwardly from the top wall to a lower edge. The skirt includes an inner surface having a sealing formation. A band is concentric with and attached to the lower edge of the skirt by a plurality of frangible members. A tab is formed at a hinge location from the band and extending from the lower edge of the skirt to one or more lines of weakness.

19 Claims, 4 Drawing Sheets

(56) References Cited

U.S. PATENT DOCUMENTS

| | | | | |
|---|---|---|---|---|
| 6,474,491 | B1 * | 11/2002 | Benoit-Gonin | B65D 41/3428 220/263 |
| 6,543,634 | B1 | 4/2003 | Parrinello | |
| 6,575,319 | B2 | 6/2003 | Zumbuhl | |
| 6,779,672 | B2 | 8/2004 | Kano et al. | |
| 6,926,162 | B1 | 8/2005 | Culley | |
| 2004/0069738 | A1 * | 4/2004 | Orth | B65D 41/3447 215/252 |
| 2011/0174760 | A1 * | 7/2011 | Luzzato | B65D 41/48 215/258 |
| 2020/0017260 | A1 | 1/2020 | Migas et al. | |
| 2021/0024258 | A1 | 1/2021 | Kraukramer | |
| 2021/0221572 | A1 * | 7/2021 | Migas | B65D 43/163 |
| 2022/0002021 | A1 * | 1/2022 | Krautkramer | B65D 41/3428 |
| 2022/0097935 | A1 * | 3/2022 | Deshpande | B65D 41/325 |
| 2022/0169423 | A1 * | 6/2022 | Lohrman | B65D 55/16 |
| 2022/0258925 | A1 * | 8/2022 | Falzoni | B65D 41/3428 |
| 2022/0267052 | A1 * | 8/2022 | Dreyer | B65D 41/3447 |
| 2022/0289441 | A1 * | 9/2022 | Zangerle | B65D 41/3428 |

FOREIGN PATENT DOCUMENTS

| | | | | |
|---|---|---|---|---|
| KR | 100997319 | B1 * | 11/2010 | B65D 55/16 |
| WO | WO-2020099200 | A1 * | 5/2020 | B65D 1/0246 |
| WO | WO2021/014287 | | 1/2021 | |
| WO | WO-2021013370 | A1 * | 1/2021 | B65D 41/3447 |
| WO | WO-2021014287 | A1 * | 1/2021 | B65D 1/0246 |
| WO | WO-2021032390 | A1 * | 2/2021 | B65D 41/3428 |
| WO | WO2021/046384 | | 3/2021 | |
| WO | WO2021/068058 | | 4/2021 | |

* cited by examiner

MODIFIED SIDEWALL OF TETHERED CLOSURE

BACKGROUND OF THE INVENTION

The present invention relates generally to a container closure having a hinged configuration that allows the closure to remain coupled to a container after the closure is opened. Specifically, whereas traditional closure plug designs are configured to permanently detach from the container after being opened, the design and configuration of the closure having a hinged configuration illustrated and described herein allows a closure to remain coupled to the container after being opened. As a result, there is a decreased likelihood that the closure may be littered.

SUMMARY OF THE INVENTION

One embodiment of the invention relates to a closure. The closure includes a top panel including an upper surface and a lower surface, a rotational axis about which the top panel is centered, a cylindrical wall extending from the lower surface of the top panel, a retention band, a first line of separation, a second line of separation, and a tether. The retention band is coupled to the cylindrical wall. The retention band is attached to a bottom edge of the cylindrical wall by a plurality of frangible connections, and provides a visual indication, when broken, that the closure has been opened. The first line of separation separates the cylindrical wall and the retention band and extends circumferentially around the closure from a first end to a second end. The plurality of frangible connections extend across the first line of separation and connect the cylindrical wall and the retention band. The bottom edge of the cylindrical wall defines a first thickness. The second line of separation extends from a first end to a second end. The first tether couples the retention band and the cylindrical wall after the plurality of frangible connections are broken. The first tether extends circumferentially around the closure between the first line of separation and the second line of separation. The first tether extends from a first end coupled to the cylindrical wall to an opposing second end coupled to the retention band. The tether defines a second thickness at one-half of the distance from the first end of the first line of separation to the second line of separation in a direction parallel to the rotational axis, and the second thickness is at least 15% thicker than the first thickness.

In a specific embodiment, the first tether defines an average thickness along a line that extends from the first end of the first line of separation to the second line of separation in a direction parallel to the rotational axis, and the average thickness is at least 10% thicker than the first thickness. In a specific embodiment, the first tether defines an average thickness along a line that extends from the first end of the second line of separation to the first line of separation in a direction parallel to the rotational axis, and the average thickness is at least 10% thicker than the first thickness.

In a specific embodiment, the first tether defines a third thickness at a lower edge of the tether, and the third thickness is at least 15% thicker than the first thickness. In a specific embodiment, the first tether defines a fourth thickness at one-third of the distance from the first end of the first line of separation to the second line of separation in a direction parallel to the rotational axis, and the fourth thickness is at least 15% thicker than the first thickness. In a specific embodiment, the first tether defines a fifth thickness at a location two-thirds of the distance from a first end of the first line of separation to the second line of separation in a direction parallel to the rotational axis, and the fifth thickness is at least 15% thicker than the first thickness.

In a specific embodiment, the first and second ends of the second line of separation are further from the top panel than the first and second ends of the first line of separation. In a specific embodiment, the first line of separation is distinct from the second line of separation. In a specific embodiment, the first line of separation extends circumferentially more than 180 degrees around the closure. In a specific embodiment, the first line of separation extends circumferentially more than 270 degrees around the closure. In a specific embodiment, the second line of separation extends circumferentially less than 180 degrees around the closure. In a specific embodiment, the second line of separation extends circumferentially less than 90 degrees around the closure.

Another embodiment of the invention relates to a closure. The closure includes a top panel including an upper surface and a lower surface, a rotational axis about which the top panel is centered, a cylindrical wall extending from the lower surface of the top panel, a retention band, a first line of separation, a second line of separation, and a first tether. The retention band is coupled to the cylindrical wall. The retention band is attached to a bottom edge of the cylindrical wall by a plurality of frangible connections, the frangible connections providing a visual indication, when broken, that the closure has been opened. The first line of separation separates the cylindrical wall and the retention band and extends circumferentially around the closure from a first end to a second end. The plurality of frangible connections extend across the first line of separation and connect the cylindrical wall and the retention band. The a second line of separation extends from a first end to a second end. The first tether couples the retention band and the cylindrical wall after the plurality of frangible connections are broken. The first tether extends between the first line of separation and the second line of separation. The first tether extends from a first end coupled to the cylindrical wall to an opposing second end coupled to the retention band. The first tether extends vertically from a first edge at the first line of separation to an opposing second edge at the second line of separation. The first tether defines a first thickness at the first edge of the first tether, and a second thickness at the second edge of the first tether, and the second thickness is at least 15% thicker than the first thickness.

Another embodiment of the invention relates to a closure. The closure includes a top panel including an upper surface and a lower surface, a rotational axis about which the top panel is centered, a cylindrical wall extending from the lower surface of the top panel, an inner surface of the cylindrical wall facing towards the rotational axis, a retention band, a first line of separation, a second line of separation, and a first tether. The retention band is coupled to the cylindrical wall. The retention band is attached to a bottom edge of the cylindrical wall by a plurality of frangible connections. The frangible connections provide a visual indication, when broken, that the closure has been opened. The first line of separation separates the cylindrical wall and the retention band and extends circumferentially around the closure from a first end to a second end. The plurality of frangible connections extend across the first line of separation and connect the cylindrical wall and the retention band. The bottom edge of the cylindrical wall defines a first thickness. The second line of separation extends from a first end to a second end. The first tether couples the retention band and the cylindrical wall after the plurality of frangible connections are broken. The first tether extends between the first line of separation and the second line of separation. The first tether extends from a first end coupled to the cylindrical wall to an opposing second end coupled to the retention band. The tether defines a second thickness that is a maximum thickness of the tether between the first line of separation and the second line of separation, and the second thickness is at least 15% thicker than the first thickness.

Additional features and advantages will be set forth in the detailed description which follows, and, in part, will be readily apparent to those skilled in the art from the description or recognized by practicing the embodiments as described in the written description included, as well as the appended drawings. It is to be understood that both the foregoing general description and the following detailed description are exemplary.

The accompanying drawings are included to provide further understanding and are incorporated in and constitute a part of this specification. The drawings illustrate one or more embodiments and, together with the description, serve to explain principles and operation of the various embodiments.

BRIEF DESCRIPTION OF THE DRAWINGS

This application will become more fully understood from the following detailed description, taken in conjunction with the accompanying figures, wherein like reference numerals refer to like elements in which.

DETAILED DESCRIPTION

Figure 1:
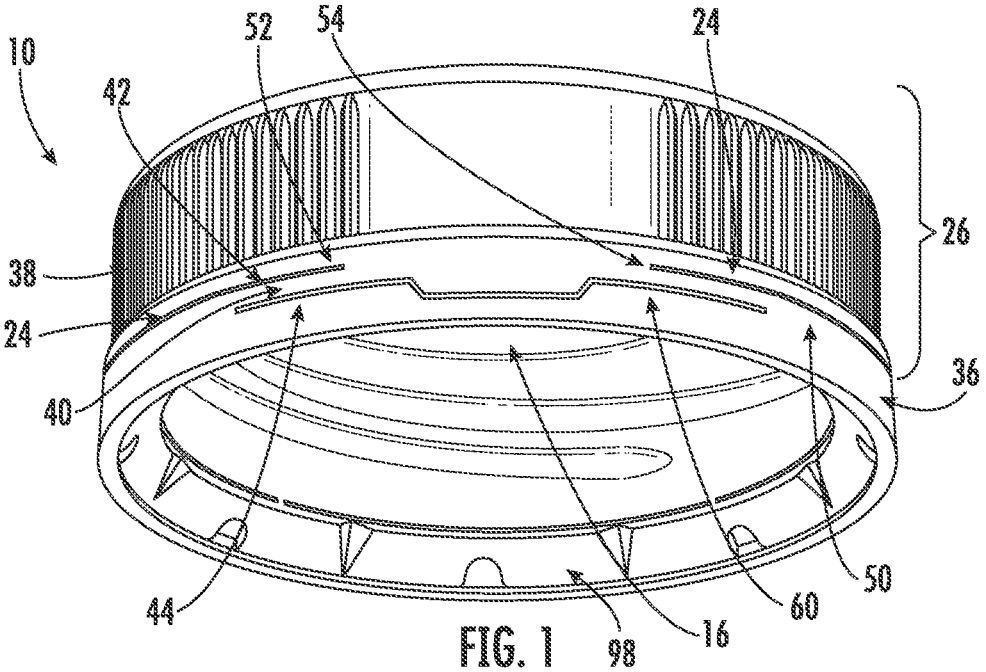
FIG. 1 is a perspective view of a closure, according to an exemplary embodiment.
Figure 2:
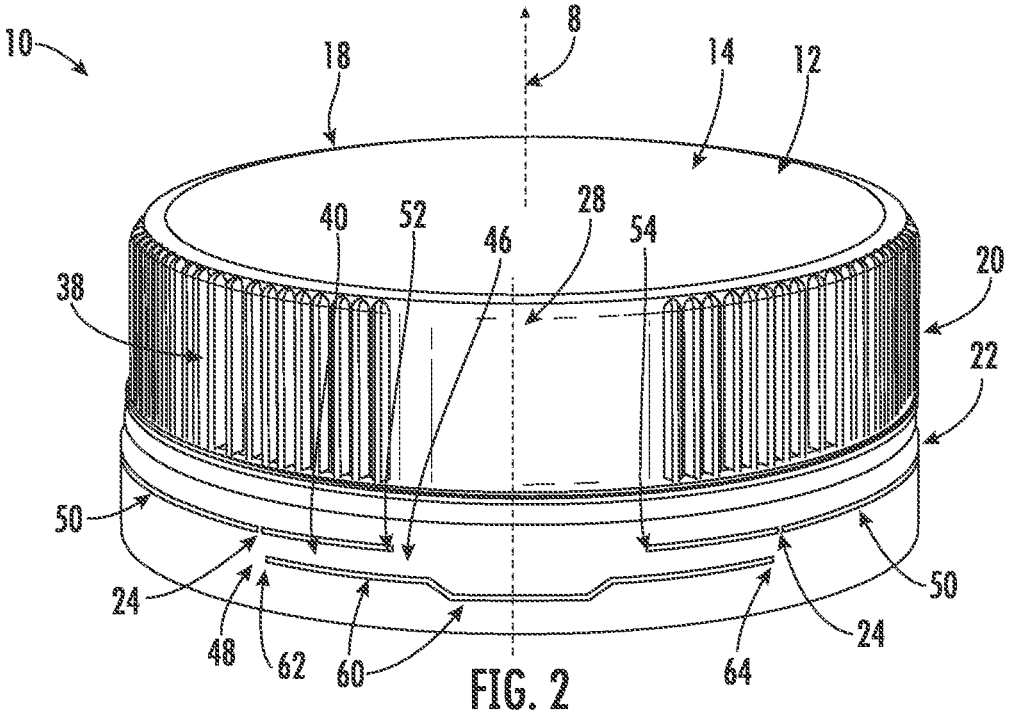
FIG. 2 is a perspective view from below of the closure of FIG. 1, according to an exemplary embodiment.

Referring generally to the figures, various aspects of a closure are shown. Closures are used to enclose storage compartments of containers, such as bottles for drinkable liquids. Many closures include a tamper band that remains permanently or semi-permanently coupled to the container neck. During some manufacturing processes, the tamper band is separated from the main body of the closure by cutting or slitting the closure. According to some embodiments, the closure has a reduced thickness at one or more of the locations where the closure is being slit compared to non-slit portions of the closure. In a specific embodiment, a tether maintaining a coupling between the tamper band and the closure body is thicker than a portion of the closure being slit. Applicant has observed that it is easier to cut slits in closures where the wall is thinner. However, such thinner walls can be less strong compared to tethers formed from thicker portions of the closure sidewalls. Accordingly, Applicant has developed one or more closures where the closure has a thinner wall portion where a slit is formed as compared to the tether.

Referring to FIGS. 1-4, a closure 10 for closing a container according to an embodiment is shown. The closure 10 includes a top panel 12 and a cylindrical wall, shown as skirt 20. The skirt 20 extends downwardly from a lower surface 16 of an outer periphery 18 of top wall 12 to lower edge 22 of skirt 20. In a specific embodiment, skirt 20 is perpendicular to top panel 12. In a specific embodiment, an inner surface of the skirt 20 faces towards the rotational axis and includes one or more coupling components, such as threads, that couple the closure 10 to a container neck. The skirt extends away from opposing upper surface 14 of top wall 12. In a specific embodiment, one or more of skirt 20 and top panel 12 are centered on an axis, shown as rotational axis 8.

A first line of separation, such as an upper weakened section, shown as a first slit 50, extends circumferentially around closure 10 from first end 52 to second end 54. In a specific embodiment, first slit 50 is an upper slit because it is above the other major slit in closure 10 (e.g., slit 60). In a various embodiments, first slit 50 includes one or more frangible connections 24 that extend across first slit 50 to couple body 26 to retaining band 36. In various embodiments, body 26 comprises skirt 20 and top panel 12. When closure 10 is initially opened, frangible connections 24 break, thus providing a visual indication that closure 10 has been opened. First slit 50 separates body 26 of closure 10 from retaining band 36.

A second line of separation, such as a lower weakened section, shown as second slit 60, extends circumferentially around closure 10. Second slit 60 extends circumferentially around closure 10 from first end 62 to second end 64. In a specific embodiment, second slit 60 is a lower slit because it is below the other major slit in closure 10 (e.g., slit 50).

In a specific embodiment, second slit 60 is distinct from first slit 50. In a specific embodiment, second slit 60 includes one or more frangible connections that break when closure 10 is opened for the first time. In a specific embodiment, second slit 60 includes no frangible connections that break when closure 10 is opened for the first time. In a specific embodiment, the second line of weakness is formed via a molding process (e.g., the closure 10 is formed with the second line of weakness so that the second line of weakness does not need to be cut or slit).

In a specific embodiment, first slit 50 extends circumferentially more than 180 degrees around closure 10, and more specifically first slit 50 extends more than 270 degrees around closure 10. In a specific embodiment, second slit 60 extends circumferentially less than 180 degrees around closure 10, and more specifically second slit 60 extends less than 120 degrees around closure 10, and more specifically second slit 60 extends less than 90 degrees around closure 10.

One or more connecting portions, shown as tethers 40, extend along closure 10 (e.g., circumferentially) between first slit 50 and second slit 60. In various embodiments, upper edge 42 of tether 40 is defined at least in part by first slit 50, and lower edge 44 of tether 40 is defined at least in part by second slit 60. In a specific embodiment, the entirety of upper edge 42 of tether 40 is defined by first slit 50. In a specific embodiment, the entirety of lower edge 44 of tether 40 is defined by second slit 60. In a specific embodiment, closure 10 includes two tethers 40 that are symmetrical to each other with respect to the front of closure 10.

In various embodiments, the one or more tethers 40 retain a coupling between body 26 (e.g., skirt 20) and retention band 36 even after frangible connections 24 are broken. In various embodiments, first end 46 of tether 40 extends from skirt 20 of body 26, and second end 48 of tether 40 extends from retention band 36.

In use, a person twists closure 10 relative to the container. As closure 10 is opened, the interaction between the threading moves closure 10 slowly upward away from the body of the container. An interfacing portion of closure 10, shown as interference band 98, interfaces with a portion of the container neck to bias interference band 98 from continuing to move upward, exerting a stretching force on frangible connections 24 until they break. After frangible connections 24 break, retention band 36 remains coupled to the container neck, and body 26 of closure 10 remains coupled to the retention band 36 via the one or more tethers 40.

Gripping elements, shown as knurls 38, project radially outward from skirt 20 with respect to axis 8, except for at a front of closure 10. In a specific embodiment, knurls 38 project outwardly from skirt 20 above first slit 50 from first end 52 to second end 54 of first slit 50.

Figure 3:
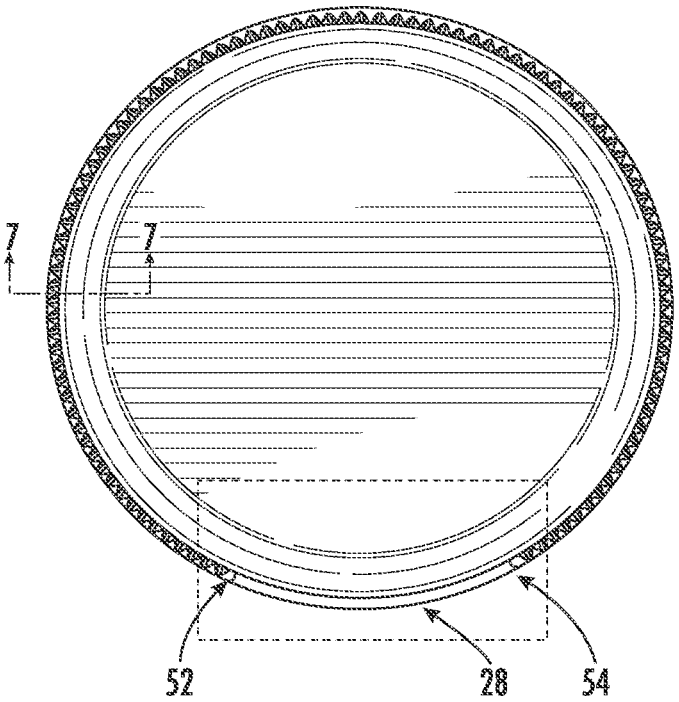
FIG. 3 is a top view of the closure of FIG. 1, according to an exemplary embodiment.
Figure 4:
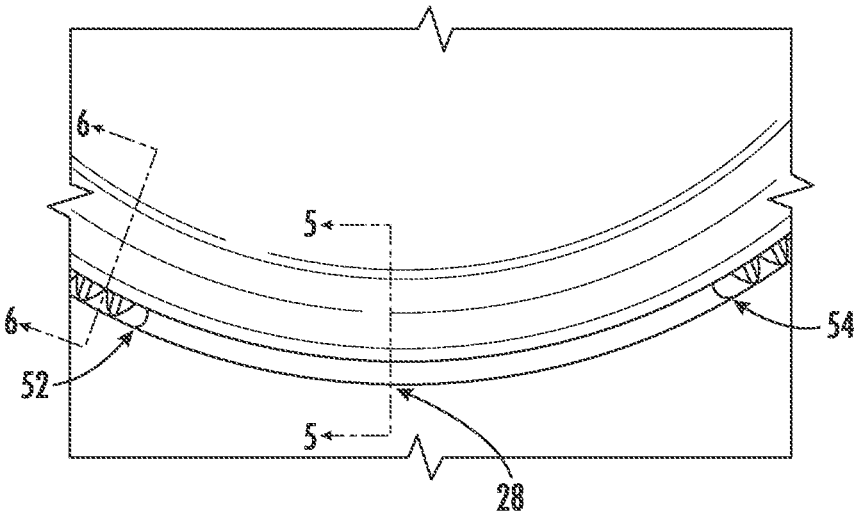
FIG. 4 is a detailed top view of the closure of FIG. 1, according to an exemplary embodiment.

Referring to FIGS. 3-4, various aspects are shown of closure 10 are shown from top views. FIGS. 3-4 identify various cross-sections shown in FIGS. 5-7.

As will be described in detail below, Applicant has observed that it can be easier to cut slits into thinner portions of closures. Applicant has also observed that tethers between closure bodies and closure retention bands have an improved performance when they are not (entirely) formed from the thinner walls where the slit is cut into the closure. Accordingly, Applicant has developed one or more closures where the closure has a thinner wall portion where a slit is formed as compared to the tether.

As will be described in more detail below, in various embodiments one or more slits are formed from a portion of closure 10 that is thinner than some or all of tethers 40. In a specific embodiment, closure 10 is slit at a portion of closure 10 that is between 30% and 95% of the thickness of the portion of closure 10 that forms some or all of tether 40. More specifically, one or more slits are formed from portions of closure 10 between 50% and 85% of the thickness of some or all of tether, and more specifically between 60% and 75%, and more specifically between 65% and 70%.

Figure 5:
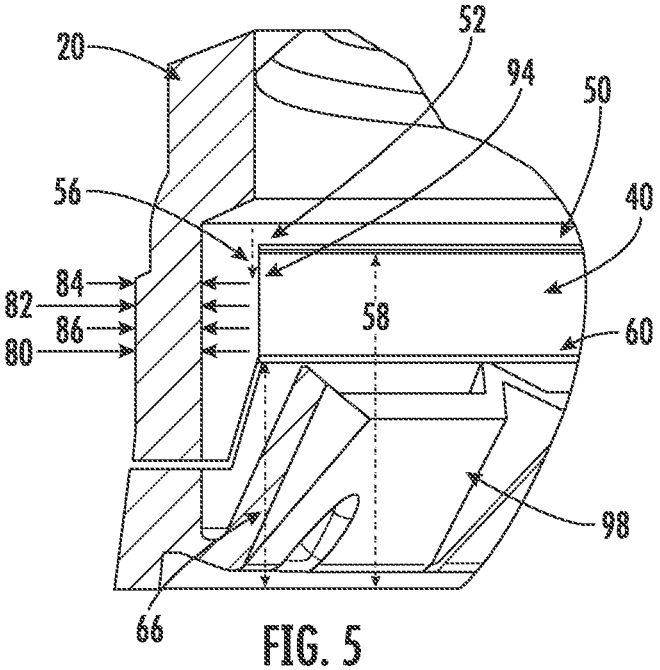
FIG. 5 is a detailed cross-section view of the closure of FIG. 1 taken along line 5-5 in FIG. 4, according to an exemplary embodiment.

Referring to FIG. 5, various aspects of a cross-section along front 28 of closure 10 are shown. The upper lateral portions of second slit 60 extends circumferentially around closure 10 at height 66 above bottom of closure 10. First slit 50 extends circumferentially around closure 10 at distance 58 above bottom of closure 10.

The sidewall of closure 10 defines a varying thickness at several different heights of closure 10. Several different locations to measure thickness of closure 10 sidewalls will first be identified. Then, relationships between the thinner and thicker portions will be described in more detail.

For example, closure 10 defines thickness 84 at one-third of the distance from first end 52 of first slit 50 to second slit 60 in downward direction 56, which is parallel to rotational axis 8. Closure 10 defines thickness 86 at two-thirds of the distance from first end 52 of first slit 50 to second slit 60 in downward direction 56. Closure 10 defines thickness 82 at one-half of the distance from first end 52 of first slit 50 to second slit 60 in downward direction 56, which is parallel to rotational axis 8. Closure 10 defines thickness 80 at one-third the distance 58 from first end 52 of first slit 50 to bottom of closure 10.

Figure 6:
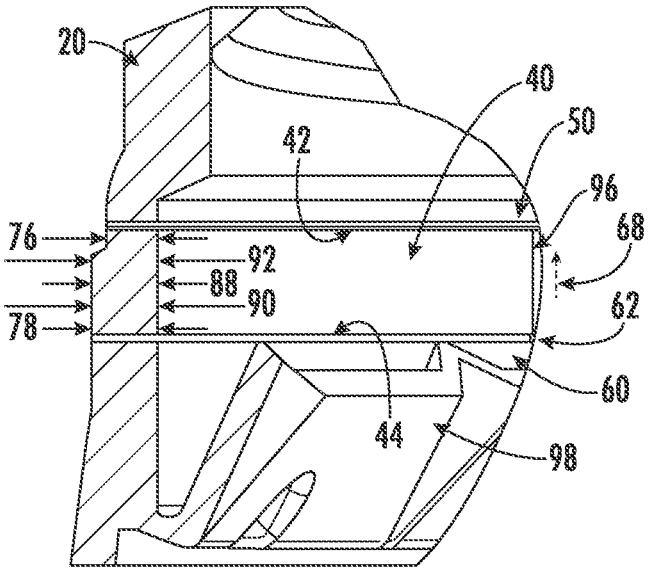
FIG. 6 is a detailed cross-section view of the closure of FIG. 1 taken along line 6-6 in FIG. 4, according to an exemplary embodiment.

In a specific embodiment, tether 40 defines an average thickness along line 94 that extends from the first end 52 of first slit 50 to the second slit 60 in a direction 56 parallel to the rotational axis. In a specific embodiment, the average thickness is at least 10% thicker than thickness 72 where first slit 50 is formed. For example, the cross-section of closure 10 seen in FIG. 5 and/or FIG. 6 depicts an exemplary varying thickness of tether 40, the average of which is 10% thicker than thickness 72 where first slit 50 is formed. In various embodiments, thickness of sidewalls, including tether 40, of closure 10 is constant at different circumferential positions around closure 10 at a given height, but thickness of sidewalls varies at different heights along closure 10.

Referring to FIG. 6, closure 10 defines thickness 90 at one-third of the distance from first end 62 of second slit 60 to first slit 50 in upward direction 68, which is parallel to rotational axis 8. Closure 10 defines thickness 92 at two-thirds of the distance from first end 62 of second slit 60 to first slit 50 in upward direction 68. Closure 10 defines thickness 88 at one-half of the distance from first end 62 of second slit 60 to first slit 50 in upward direction 68, which is parallel to rotational axis 8. Closure 10 defines thickness 76 at top edge 42 of tether 40. Closure 10 defines thickness 78 at bottom edge 44 of tether 40. Although thickness 90, 92, 88 is shown in FIG. 6 at a position slightly adjacent to first end 62 of second slit 60, it will be understood that thickness 90, 92, 88 is the same above first end 62 in various embodiments.

In a specific embodiment, tether 40 defines an average thickness along line 96 that extends from the first end 62 of second slit 60 to the first slit 50 in a direction 68 parallel to the rotational axis. In a specific embodiment, the average thickness is at least 10% thicker than thickness 72 at bottom of skirt 20 (e.g., where slit 50 is formed).

Figure 7:
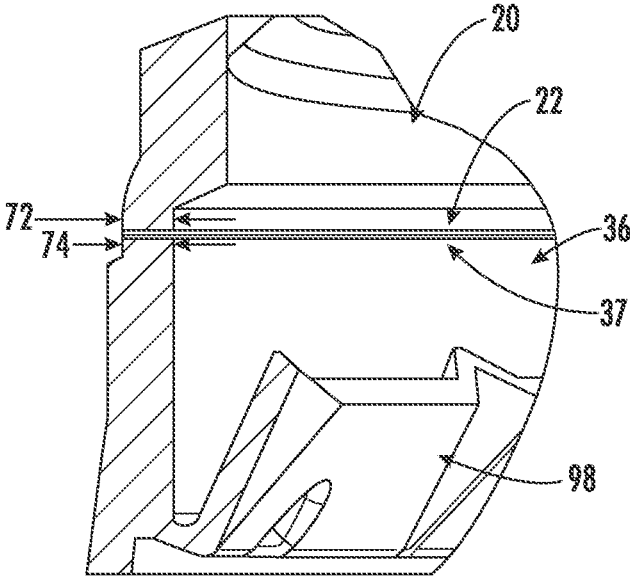
FIG. 7 is a detailed cross-section view of the closure of FIG. 1 taken along line 7-7 in FIG. 3, according to an exemplary embodiment.

Referring to FIG. 7, closure 10 defines thickness 72 at bottom of skirt 20 (e.g., nearest first slit 50). Closure 10 defines thickness 74 at top of retention band 36 (e.g., nearest first slit 50).

In various embodiments, the thinner portions of closure 10 from which first slit 50 is formed are one or more of a bottom of skirt 20 (having thickness 72), a top 37 of retention band 36 (having thickness 74) adjacent first slit 50, and a top of tether 40 (having thickness 76). In a various embodiments, the thinner portions of closure (e.g, thickness 72, 74, 76) are less than 85% the thickness of a maximum thickness of tether 40.

In various embodiments, the thicker portions of closure 10 forming some or all of tether 40 are one-third of the distance from first end 52 of first slit 50 to second slit 60 (having thickness 84), one-half of the distance from first end 52 of first slit 50 to second slit 60 (having thickness 82), two-thirds of the distance from first end 52 of first slit 50 to second slit 60 (having thickness 86), one-third of the distance from first end 62 of second slit 60 to first slit 50 (having thickness 90), one-half of the distance from first end 62 of second slit 60 to first slit 50 (having thickness 88), and two-thirds of the distance from first end 62 of second slit 60 to first slit 50 (having thickness 92).

In a specific embodiment, the thicker portion is at least 10% thicker than the thinner portion, and more specifically at least 15% thicker, and more specifically at least 30% thicker, and more specifically at least 45% thicker. In a specific embodiment, the thicker portions of closure 10, such as those forming all or more of tethers 40, have a thickness of 0.035 mm, and the portions of closure 10 that are slit, such as where first slit 50 is formed, have a thickness of 0.024 mm.

In a specific embodiment, most of tether 40 is formed from the thicker portions of closure 10 as identified above, such as 51% or more of tether 40, or more specifically 70% or more, or more specifically 80% or more of tether 40.

It should be understood that the figures illustrate the exemplary embodiments in detail, and it should be understood that the present application is not limited to the details or methodology set forth in the description or illustrated in the figures. It should also be understood that the terminology is for description purposes only and should not be regarded as limiting.

Further modifications and alternative embodiments of various aspects of the disclosure will be apparent to those skilled in the art in view of this description. Accordingly, this description is to be construed as illustrative only. The construction and arrangements, shown in the various exemplary embodiments, are illustrative only. Although only a few embodiments have been described in detail in this disclosure, many modifications are possible (e.g., variations in sizes, dimensions, structures, shapes and proportions of the various elements, values of parameters, mounting arrangements, use of materials, colors, orientations, etc.) without materially departing from the novel teachings and advantages of the subject matter described herein. Some elements shown as integrally formed may be constructed of multiple parts or elements, the position of elements may be reversed or otherwise varied, and the nature or number of discrete elements or positions may be altered or varied. The order or sequence of any process, logical algorithm, or method steps may be varied or re-sequenced according to alternative embodiments. Other substitutions, modifications, changes and omissions may also be made in the design, operating conditions and arrangement of the various exemplary embodiments without departing from the scope of the present disclosure.

Unless otherwise expressly stated, it is in no way intended that any method set forth herein be construed as requiring that its steps be performed in a specific order. Accordingly, where a method claim does not actually recite an order to be followed by its steps or it is not otherwise specifically stated in the claims or descriptions that the steps are to be limited to a specific order, it is in no way intended that any particular order be inferred. In addition, as used herein, the article "a" is intended to include one or more component or element, and is not intended to be construed as meaning only one. As used herein, "rigidly coupled" refers to two components being coupled in a manner such that the components move together in a fixed positional relationship when acted upon by a force.

Various embodiments of the disclosure relate to any combination of any of the features, and any such combination of features may be claimed in this or future applications. Any of the features, elements or components of any of the exemplary embodiments discussed above may be utilized alone or in combination with any of the features, elements or components of any of the other embodiments discussed above.

For purposes of this disclosure, the term "coupled" means the joining of two components directly or indirectly to one another. Such joining may be stationary in nature or movable in nature. Such joining may be achieved with the two members and any additional intermediate members being integrally formed as a single unitary body with one another or with the two members or the two members and any additional member being attached to one another. Such joining may be permanent in nature or alternatively may be removable or releasable in nature.

While the current application recites particular combinations of features in the claims appended hereto, various embodiments of the invention relate to any combination of any of the features described herein whether or not such combination is currently claimed, and any such combination of features may be claimed in this or future applications. Any of the features, elements, or components of any of the exemplary embodiments discussed above may be used alone or in combination with any of the features, elements, or components of any of the other embodiments discussed above.

In various exemplary embodiments, the relative dimensions, including angles, lengths and radii, as shown in the Figures are to scale. Actual measurements of the Figures will disclose relative dimensions, angles and proportions of the various exemplary embodiments. Various exemplary embodiments extend to various ranges around the absolute and relative dimensions, angles and proportions that may be determined from the Figures. Various exemplary embodiments include any combination of one or more relative dimensions or angles that may be determined from the Figures. Further, actual dimensions not expressly set out in this description can be determined by using the ratios of dimensions measured in the Figures in combination with the express dimensions set out in this description.

What is claimed is:

1. A closure comprising:

a top panel including an upper surface and a lower surface;

a rotational axis about which the top panel is centered;

a cylindrical wall extending from the lower surface of the top panel;

a retention band coupled to the cylindrical wall, the retention band attached to a bottom edge of the cylindrical wall by a plurality of frangible connections, the frangible connections providing a visual indication, when broken, that the closure has been opened;

a first line of separation separating the cylindrical wall and the retention band and extending circumferentially around the closure from a first end to a second end, the plurality of frangible connections extending across the first line of separation and connecting the cylindrical wall and the retention band, the bottom edge of the cylindrical wall defining a first thickness;

a second line of separation extending from a first end to a second end, wherein the first and second ends of the second line of separation are further from the top panel than the first and second ends of the first line of separation; and a first tether coupling the retention band and the cylindrical wall after the plurality of frangible connections are broken, the first tether extending circumferentially around the closure between the first line of separation and the second line of separation, the first tether extending from a first end coupled to the cylindrical wall to an opposing second end coupled to the retention band, the tether defining a second thickness at one-half of the distance from the first end of the first line of separation to the second line of separation in a direction parallel to the rotational axis, wherein the second thickness is at least 15% thicker than the first thickness, the first tether defining a third thickness at one-third of the distance from the first end of the first line of separation to the second line of separation in a direction parallel to the rotational axis, wherein the third thickness is at least 15% thicker than the first thickness to reduce a thickness of the cylindrical wall being slit at the first line of separation and avoid breakage of the first tether.

2. The closure of claim 1, the first tether defining an average thickness along a line that extends from the first end of the first line of separation to the second line of separation in a direction parallel to the rotational axis, wherein the average thickness is at least 10% thicker than the first thickness.

3. The closure of claim 1, the first tether defining an average thickness along a line that extends from the first end of the second line of separation to the first line of separation in a direction parallel to the rotational axis, wherein the average thickness is at least 10% thicker than the first thickness.

4. The closure of claim 1, the first tether defining a fourth thickness at a lower edge of the first tether, wherein the fourth thickness is at least 15% thicker than the first thickness.

5. The closure of claim 1, the first tether defining a fifth thickness at a location two-thirds of the distance from a first end of the first line of separation to the second line of separation in a direction parallel to the rotational axis, wherein the fifth thickness is at least 15% thicker than the first thickness.

6. The closure of claim 1, the first line of separation is distinct from the second line of separation.

7. The closure of claim 1, the first line of separation extends circumferentially more than 180 degrees around the closure.

8. The closure of claim 1, the first line of separation extends circumferentially more than 270 degrees around the closure.

9. The closure of claim 8, the second line of separation extends circumferentially less than 180 degrees around the closure.

10. The closure of claim 1, the second line of separation extends circumferentially less than 90 degrees around the closure, the closure comprising a second tether coupling the retention band and the cylindrical wall after the plurality of frangible connections are broken.

11. A closure comprising:

a top panel including an upper surface and a lower surface;

a rotational axis about which the top panel is centered;

a cylindrical wall extending from the lower surface of the top panel;

a retention band coupled to the cylindrical wall, the retention band attached to a bottom edge of the cylindrical wall by a plurality of frangible connections, the frangible connections providing a visual indication, when broken, that the closure has been opened;

a first line of separation separating the cylindrical wall and the retention band and extending circumferentially around the closure from a first end to a second end, the plurality of frangible connections extending across the first line of separation and connecting the cylindrical wall and the retention band;

a second line of separation extending from a first end to a second end; and a first tether coupling the retention band and the cylindrical wall after the plurality of frangible connections are broken, the first tether extending between the first line of separation and the second line of separation, the first tether extending from a first end coupled to the cylindrical wall to an opposing second end coupled to the retention band, the first tether extending vertically from a first edge at the first line of separation to an opposing second edge at the second line of separation, the first tether defining:

a first thickness at the first edge of the first tether; and a second thickness at the second edge of the first tether, wherein the second thickness is at least 15% thicker than the first thickness, the first tether defining a third thickness at one-third of the distance from the first end of the first line of separation to the second line of separation in a direction parallel to the rotational axis, wherein the third thickness is at least 15% thicker than the first thickness to reduce a thickness of the cylindrical wall being slit at the first line of separation and avoid breakage of the first tether.

12. The closure of claim 11, wherein the first and second ends of the second line of separation are further from the top panel than the first and second ends of the first line of separation, the closure comprising a second tether coupling the retention band and the cylindrical wall after the plurality of frangible connections are broken.

13. The closure of claim 11, wherein the first line of separation circumferentially extends more than 180 degrees around the closure and the second line of separation circumferentially extends less than 180 degrees around the closure.

14. The closure of claim 11, the retention band defining a fourth thickness at a top of the retention band adjacent to the first line of separation, wherein the second thickness is at least 15% thicker than the fourth thickness.

15. The closure of claim 11, the retention band defining a fourth thickness at a bottom of the first tether adjacent to the second line of separation, wherein the fourth thickness is at least 15% thicker than the first thickness.

16. The closure of claim 11, wherein the first line of separation circumferentially extends more than 270 degrees around the closure and the second line of separation circumferentially extends less than 120 degrees around the closure.

17. A closure comprising:

a top panel including an upper surface and a lower surface;

a rotational axis about which the top panel is centered;

a cylindrical wall extending from the lower surface of the top panel;

an inner surface of the cylindrical wall facing towards the rotational axis;

a retention band coupled to the cylindrical wall, the retention band attached to a bottom edge of the cylindrical wall by a plurality of frangible connections, the frangible connections providing a visual indication, when broken, that the closure has been opened;

a first line of separation separating the cylindrical wall and the retention band and extending circumferentially around the closure from a first end to a second end, the plurality of frangible connections extending across the first line of separation and connecting the cylindrical wall and the retention band, the bottom edge of the cylindrical wall defining a first thickness;

a second line of separation extending from a first end to a second end, wherein the first and second ends of the second line of separation are further from the top panel than the first and second ends of the first line of separation; and a first tether coupling the retention band and the cylindrical wall after the plurality of frangible connections are broken, the first tether extending between the first line of separation and the second line of separation, the first tether extending from a first end coupled to the cylindrical wall to an opposing second end coupled to the retention band, the tether defining a second thickness that is a maximum thickness of the tether between the first line of separation and the second line of separation, wherein the second thickness is at least 10% thicker than the first thickness, the first tether defining a third thickness at two-thirds of the distance from the first end of the second line of separation to the first line of separation in a direction parallel to the rotational axis, wherein the third thickness is at least 10% thicker than the first thickness, wherein at least 70% of the first tether defines a thickness at least 10% thicker than the first thickness to reduce a thickness of the cylindrical wall being slit at the first line of separation and avoid breakage of the first tether, the first tether defining a fourth thickness at one-third of the distance from the first end of the first line of separation to the second line of separation in a direction parallel to the rotational axis, wherein the fourth thickness is at least 15% thicker than the first thickness to reduce a thickness of the cylindrical wall being slit at the first line of separation and avoid breakage of the first tether.

18. The closure of claim 17, the closure comprising a second tether coupling the retention band and the cylindrical wall after the plurality of frangible connections are broken.

19. The closure of claim 17, wherein at least 70% of the first tether defines a thickness at least 30% thicker than the first thickness.

* * * * *